United States Patent [19]

Okuda et al.

[11] Patent Number: 4,864,965

[45] Date of Patent: Sep. 12, 1989

[54] AUTOMATIC PAINTING APPARATUS

[75] Inventors: Masaharu Okuda, Tokyo; Toraji Kawatoko, Komae, both of Japan

[73] Assignee: Taikisha Ltd., Tokyo, Japan

[21] Appl. No.: 148,388

[22] Filed: Jan. 25, 1988

[30] Foreign Application Priority Data

Jan. 26, 1987 [JP] Japan ..... 62-10093[U]

[51] Int. Cl.[4] ..... B05B 15/12

[52] U.S. Cl. ..... 118/323; 118/326

[58] Field of Search ..... 118/323, 326

[56] References Cited

U.S. PATENT DOCUMENTS

| | | | |
|---|---|---|---|
| 3,509,852 | 5/1970 | Wells | 118/323 |
| 3,703,880 | 11/1972 | Wampler | 118/323 |
| 3,831,342 | 8/1974 | Rejsa | 118/323 X |
| 3,878,812 | 4/1975 | Takeuchi | 118/323 X |
| 4,231,239 | 11/1980 | Lazaroff | 118/323 X |
| 4,616,594 | 10/1986 | Itho | 118/326 |

*Primary Examiner*—Shrive Beck

*Attorney, Agent, or Firm*—Webb, Burden, Ziesenheim & Webb

[57] ABSTRACT

An automatic painting apparatus comprising a spraying booth having ceiling openings through which ventilating air is delivered to the spraying booth in downward laminar flows. The spraying booth houses a portal framework including a pair of vertical frames disposed on both sides of a conveying track of articles under a spraying treatment, and a cross frame extending between the vertical frames over and across the article conveying track. The cross frame carries spray guns for spraying paint downwardly. A spray gun moving mechanism connects the cross frame to the vertical frames to be dispaceable longitudinally of the cross frame. One of the vertical frames includes a cross frame drive mechanism for reciprocating the cross frame longitudinally thereof.

4 Claims, 4 Drawing Sheets

AUTOMATIC PAINTING APPARATUS

BACKGROUND OF THE INVENTION (1) Field of the Invention

The present invention relates to an automatic painting apparatus for spray painting articles such as automobile bodies and casings for household electrical appliances. More particularly, the invention relates to an automatic painting apparatus comprising a spraying region having ceiling supply openings for delivering a ventilating gas in downward laminar flows, a portal framework disposed in the spraying region and including a pair of vertical frames disposed on both sides of a conveying track of articles under a spraying treatment, and a cross frame extending between the vertical frames over and across the article conveying track, spray guns attached to the cross frame for spraying paint downwardly, and a spray gun moving mechanism mounted on the portal framework for reciprocating the spray guns longitudinally of the cross frame.

(2) Description of the Prior Art

In known automatic painting apparatus as noted above, the spray guns attached to the cross frame for spraying paint downwardly are reciprocated longitudinally of the cross frame (i.e. transversely of the article conveying track). More particularly, as shown in FIGS. 7 and 8, spray guns 6 are attached to a longitudinally immovable cross frame 5 to be displaceable longitudinally of the cross frame 5 by means of an oscillation guide mechanism 36, an oscillation link mechanism, a roller mechanism or other movable support mechanism. Spray guns 6 are reciprocated by a drive motor 23 through a crank mechanism 37 or other transmission mechanism supported by the cross frame 5.

In the drawings, number 8 indicates ceiling supply openings for delivering a ventilating gas in downward laminar flows. Number 4 indicates vertical frames disposed on both sides of an article conveying track F. Reference A indicates an article under a spraying treatment.

The ventilating gas is delivered through the ceiling supply openings in downward laminar flows in order to stabilize paint spraying with respect to the article. With the above construction, however, the ventilating gas flows are obstructed by the movable support mechanism for displaceably attaching the spray guns to the cross frame and by the crank mechanism or other transmission mechanism supported by the cross frame, whereby disturbances take place with the laminar flows of the ventilating gas downwardly of these mechanisms. In particular, a greater resistance occurs with the ventilating gas flows on the lefthand side than the righthand side of FIG. 8. As a result, the paint spraying state becomes disordered, giving rise to the problem of uneven spraying and low paint adhesion efficiency.

SUMMARY OF THE INVENTION

The object of the present invention is to check the disturbances of the laminar flows of the ventilating gas by improving the structure for reciprocating the spray guns.

The above object is achieved according to the present invention by an automatic painting apparatus comprising a portal framework including a pair of vertical frames disposed on both sides of a conveying track of articles under a spraying treatment and a cross frame extending between the vertical frames over and across the article conveying track, spray guns attached to the cross frame, and a spray gun moving mechanism connecting the cross frame to the vertical frames to be dispaceable longitudinally of the cross frame, and including a cross frame drive mechanism mounted in at least one of the vertical frames for reciprocating the cross frame longitudinally thereof.

The above construction causes reciprocation of the cross frame itself, whereby the spray guns attached to the cross frame are reciprocable with the cross frame longitudinally of the latter. Consequently, the invention has eliminated the mechanisms which were obstructive to the ventilating gas flows in the prior art, such as the movable support mechanism for displaceably attaching the spray guns to the cross frame and the crank mechanism or other transmission mechanism supported by the cross frame.

With the movable support mechanism and the transmission mechanism no longer required, the cross frame itself may be formed as thin as possible to check disturbances of the ventilating gas flows caused by its presence. Furthermore, since the cross frame drive mechanism for reciprocating the cross frame longitudinally thereof is included in one of the vertical frames disposed laterally of the article conveying track, the cross frame drive mechanism presents no obstruction to the article conveying track or the laminar flows of ventilating gas above.

Thus, compared with the prior art, the above features of the invention combine to check the disturbances of the laminar flows of ventilating gas to a great extent.

As a result, the disturbances of the laminar flows of ventilating gas are checked to effectively avoid uneven painting and lowering of the paint adhering efficiency. The automatic painting apparatus according to the present invention is capable of carrying out a spray painting operation with a high quality finish.

Other features and advantages of the present invention will be apparent from the following description.

BRIEF DESCRIPTION OF THE DRAWINGS

FIGS. 1 through 6 illustrate an embodiment of the present invention, in which:

FIG. 1 is a sectional view of a spraying booth,

FIG. 2 is a plan view of the spraying booth,

FIG. 3 is a view of an overall construction, partly omitted, of an automatic spraying machine, FIG. 4 is a section taken on line IV—IV in FIG. 3, FIG. 5 is a section taken on line V—V in FIG. 3, and FIG. 6 is a section taken on line VI—VI in FIG. 3.

FIGS. 7 and 8 illustrate a known example, in which:

FIG. 7 is a sectional view of a known spraying booth, and

FIG. 8 is a plan view of the known spraying booth.

DESCRIPTION OF THE PREFERRED EMBODIMENT

An embodiment of the present invention will be described hereinafter with reference to the drawings.

Figure 1:
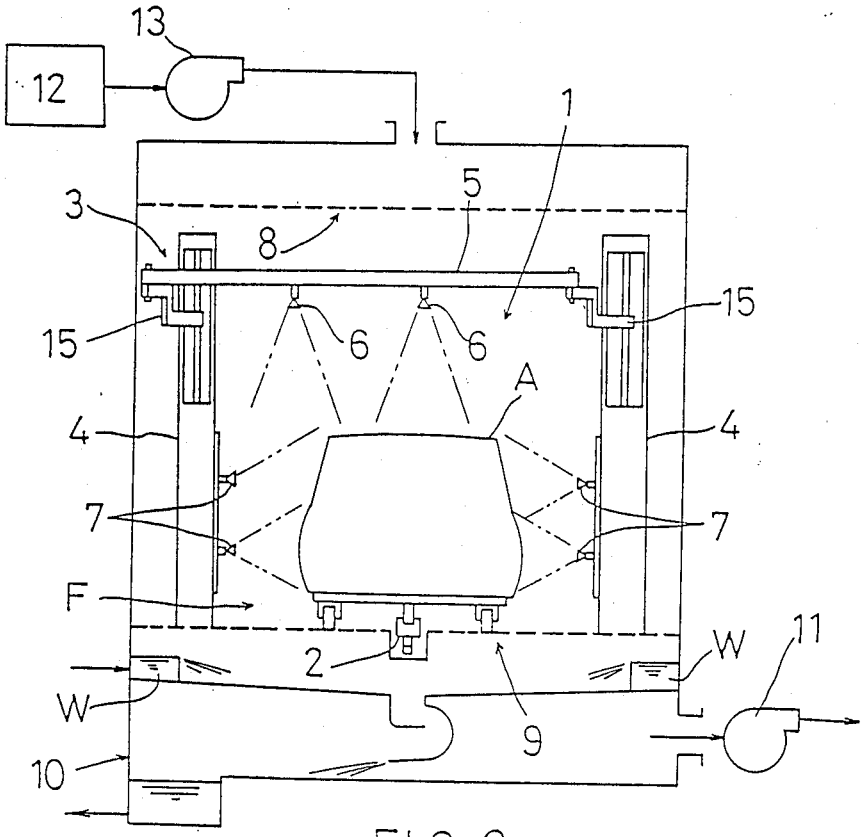
Figure 2:
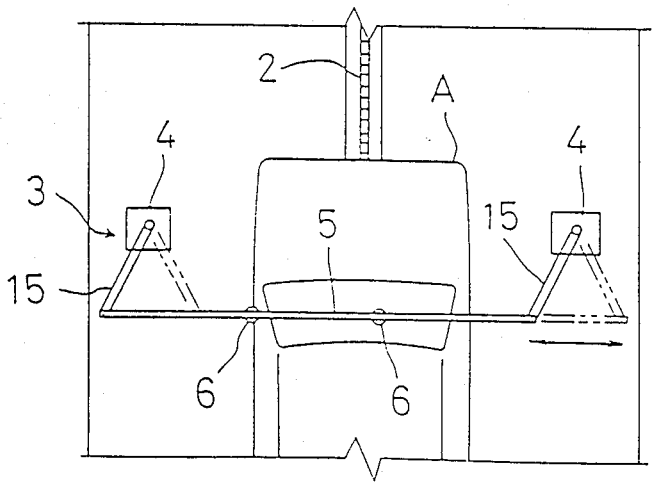
Figure 3:
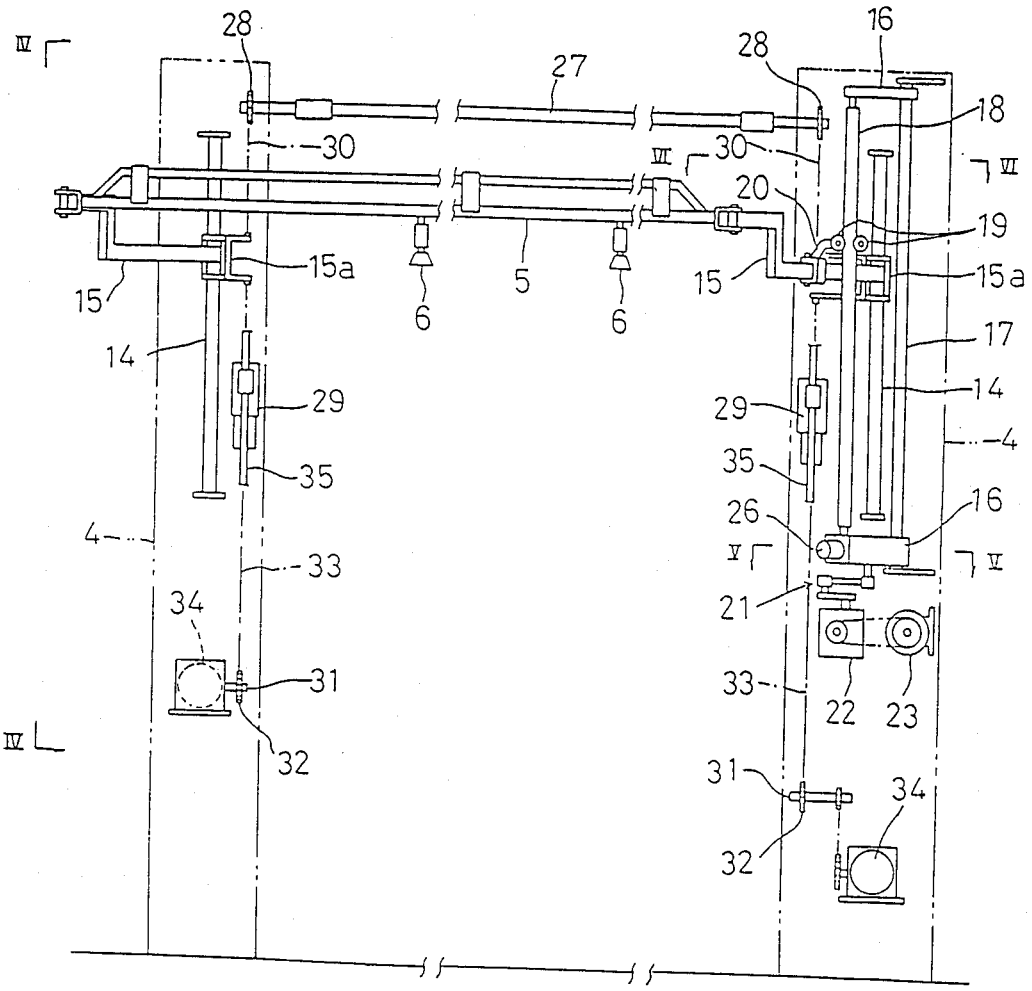
Figure 4:
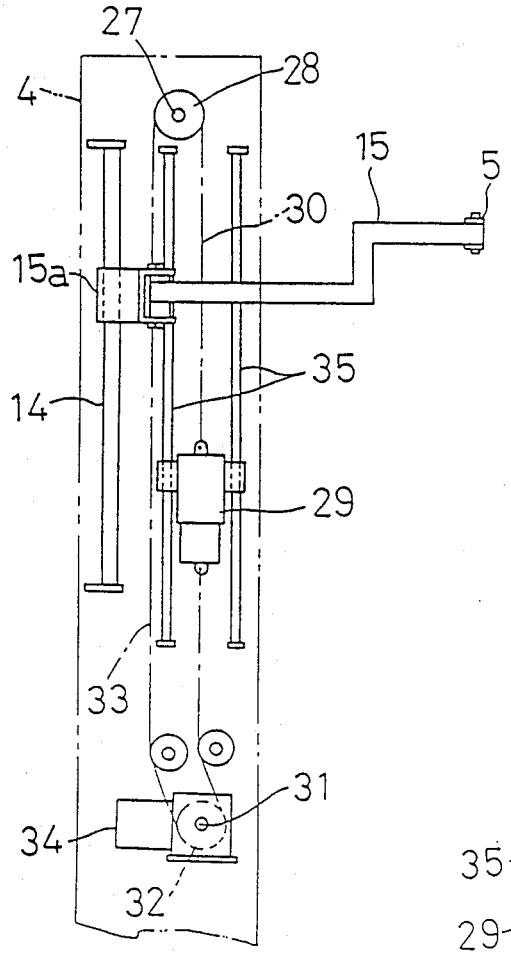
Figure 5:
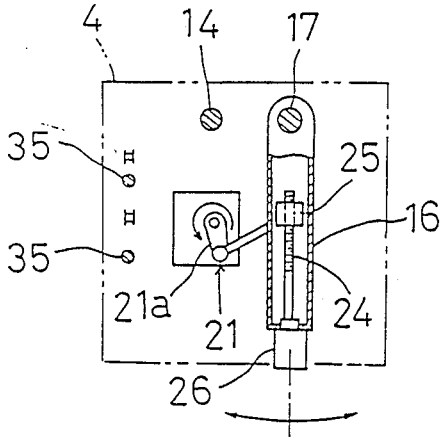
Figure 6:
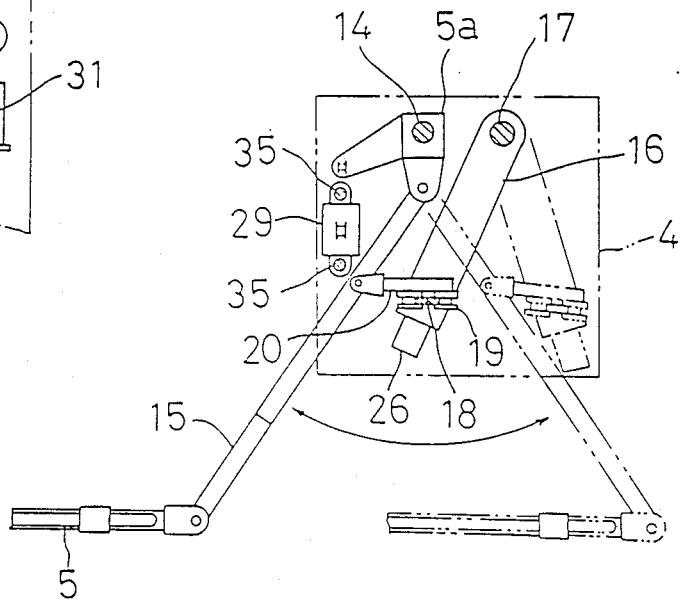
Figure 7:
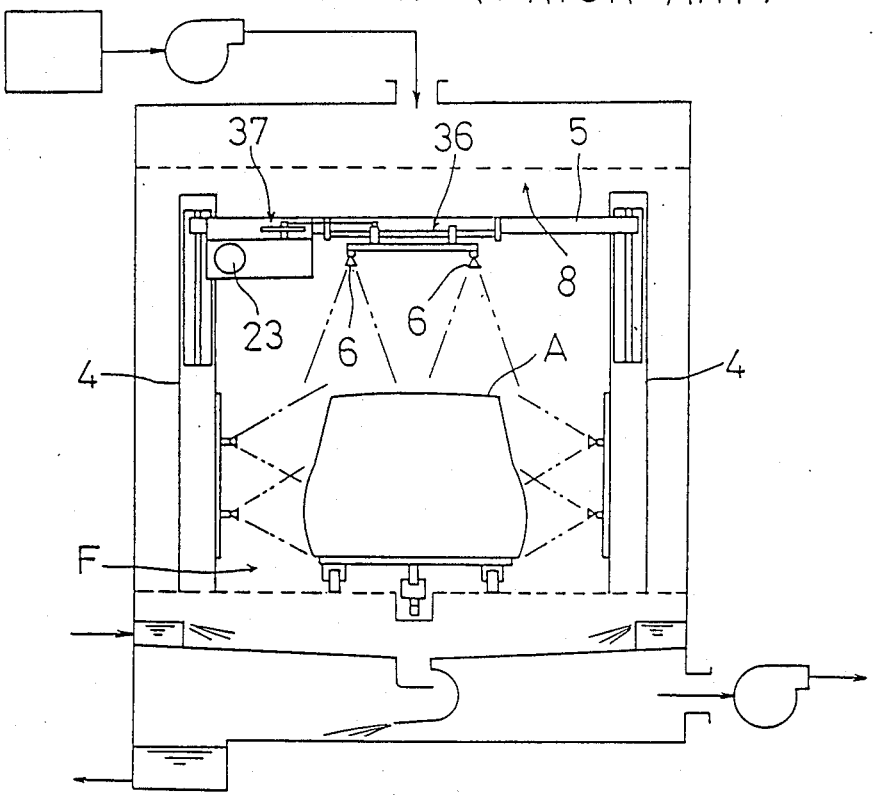
FIG.7 (PRIOR ART)
Figure 8:
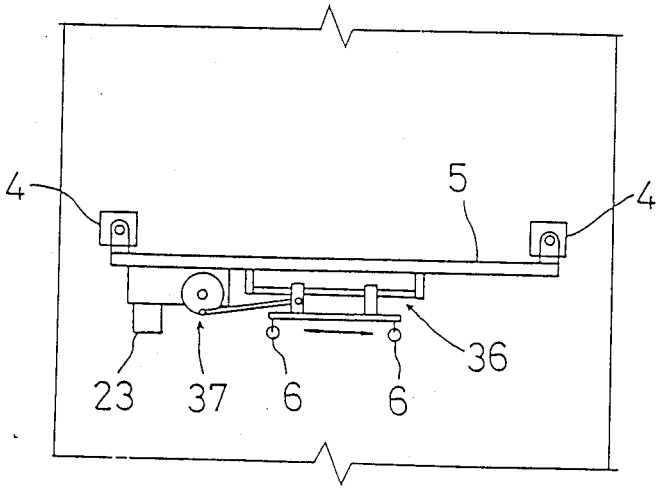
FIG.8 (PRIOR ART)

FIGS. 1 and 2 show a spraying booth constituting an automatic paint spraying apparatus. The booth defines a paint spraying region 1 through which a conveyor 2 carries an article A under a spraying treatment. An automatic spraying machine 3 is disposed midway along an article conveying track F to carry out electrostatic spray painting of the article A.

The automatic spraying machine 3 comprises a portal framework including vertical frames 4 upstanding on both sides of the article conveying track F and a cross frame 5 extending between the vertical frames 4 over and across the article conveying track F. The cross frame 5 carries spray guns 6 for spraying paint downwardly, which are reciprocable longitudinally of the cross frame 5, i.e. transversely of the article conveying track F. Each of the vertical frames 4 carries spray guns 7 for spraying paint horizontally, which are reciprocable vertically.

The paint spraying region 1 has supply openings 8 extending substantially over an entire ceiling area thereof for delivering ventilating air in downward laminar flows. The floor of the paint spraying region 1 defines exhaust openings 9 for discharging the air and overspray paint mist from the spraying region. The downward laminar flows of ventilating air through these supply and exhaust openings stabilize the paint spray dispersion to check uneven coating of the paint, and improve the efficiency of paint adhesion. Further, such flows are effective to dispose of the overspray paint mist promptly thereby to prevent a next article from becoming stained with residual paint mist in flotation.

In the drawings, number 10 indicates a paint mist removing device for removing the paint mist from the ventilating air discharged through the floor exhaust openings 9 by trapping the paint mist in cleaning water W. Number 11 indicates an air exhaust fan, number 12 indicates an air conditioner, and number 13 indicates an air supply fan.

The automatic spraying machine 3 includes a structure for reciprocating the downwardly directed spray guns 6 attached to the cross frame 5 as shown in FIGS. 3 through 6. As seem from these drawings, each of the vertical frames 4 has a rectangular pipe shape to act as a casing which houses a vertical guiding support shaft 14. A cross frame support arm 15 is attached to each guiding support shaft 14 to be oscillatable transversely of the article conveying track F.

The cross frame 5 extends between the cross frame support arms 15 with opposite ends thereof pivotally connected to free ends of the support arms 15, respectively. This support structure of the vertical frames 4 for supporting the cross frame 5 allows the cross frame 5 to be displaceable in the direction in which the latter extends.

One of the vertical frames 4 further houses a rotary shaft 17 carrying oscillatable arms 16 at an upper position and a lower position thereof, respectively. A guide rod 18 having a band plate shape extends between free ends of the upper and lower oscillatable arms 16 to be rotatable on a vertical axis thereof.

The cross frame support arm 15 of the same vertical frame 4 has a transmission arm 20 attached thereto to be oscillatable on a vertical axis, the transmission arm 20 carrying a plurality of rollers 19 each defining an engaging groove. The rollers 19 are placed in engagement with the guide rod 18 of band plate shape at transversely opposite sides thereof. Thus the upper and lower oscillatable arms 16 and the cross frame support arm 15 are oscillatably interlocked through the guide rod 18 and transmission arm 20.

A motor 23 disposed in a bottom region of the vertical frame 4 drives the lower oscillatable arm 16 through a crank mechanism 21 and a speed reducer 22 to oscillate back and forth, which causes the cross frame support arm 15 to oscillate back and forth. This reciprocating oscillation of the support arm 15 reciprocates the cross frame 5 longitudinally thereof, whereby the downwardly directed spray guns 6 attached to the cross frame 5 reciprocate with the cross frame 5.

The lower oscillatable arm 16 and crank mechanism 21 are connected to each other as follows. The lower oscillatable arm 16 includes a piece 25 mounted on a screw shaft 24 to be positionally adjustable in the longitudinal direction of the oscillatable arm 16 by turning the screw shaft 24. The crank mechanism 21 includes a crank arm 21*a* pivotally connected to the piece 25.

In other words, the stroke of oscillation of the oscillatable arm 16 is variable with the positional adjustment of the piece 25 effected by turning the screw shaft 24. Thus, the stroke of reciprocation of the cross frame 5, namely the stroke of reciprocation of the downwardly directed spray guns 6, may be adjusted as necessary.

Number 26 in the drawings indicates a stroke adjusting motor attached to the lower oscillatable arm 16 for turning the screw shaft 24.

In addition to the reciprocation, the cross frame 5 is vertically movable to adjust the height of the downwardly directed spray guns 6.

A structure for raising and lowering the cross frame 5 includes a slide member 15*a* through which each of the cross frame support arms 15 is vertically slidably attached to the guiding support shaft 14. The interlocking structure between the cross frame support arm 15 and the oscillatable arms 16 permits vertical movements of the support arm 15 through rotations of the rollers 19 in engagement with the band-shaped guide rod 18.

Aside from the cross frame 5, there is provided a synchronizing rotary shaft 27 extending between the vertical frames 4 over the article conveying track F. Each of the vertical frames 4 houses a sprocket 28 attached to the synchronizing rotary shaft 27. An upper chain 30 is wound around the sprocket 28 with one end thereof connected to the slide member 15*a* of the cross frame support arm 15 and the other end connected to a balance weight 29.

Each vertical frame 4 houses a sprocket shaft 31 carrying a sprocket 32 in a bottom region thereof. A lower chain 33 is wound around the sprocket 32 with one thereof connected to the slide member 15*a* of the support arm 15 and the other end connected to the balance weight 29 as in the case of the upper chain 30.

Each sprocket shaft 31 is driven by a raising and lowering motor 34 disposed in the bottom region of each vertical frame 4. Thus, the cross frame 5 is raised and lowered by moving the cross frame support arms 15 up and down at a speed synchronized by the synchronizing rotary shaft 27.

Number 35 in the drawings indicates guide rods for guiding the vertical movement of the balance weights 29.

Modified embodiments of the invention will be described hereinafter.

Various improvements may be made in the specific support structure for attaching the cross frame 5 to the vertical frames 4 to be displaceable longitudinally thereof. The mode of its displacement may be a longitudinal sliding displacement instead of the oscillatory displacement employed in the foregoing embodiment.

The cross frame 5 may be driven to reciprocate longitudinally thereof by various drive mechanisms. Instead of interlocking the cross frame 5 with the oscillatory drive mechanism as in the foregoing embodiment, the cross frame 5 may be moved by a feed action of a screw drive mechanism or may be interlocked with an extension and contraction drive mechanism. These various drive structures are collectively called herein the cross frame drive mechanism.

Further, various improvements may be made in the specific structure for attaching the cross frame drive mechanism to the vertical frames 4 of the portal framework so as to present no obstruction to the article conveying track F and the laminar flows of ventilating air above.

The downwardly directed spray guns 6 may be attached to the cross frame to be movable to a certain extent relative thereto. It will serve the purpose if the reciprocation of the cross frame 5 in substance results in the reciprocation of the spray guns 6.

What is claimed is:

1. An automatic painting apparatus comprising:

a spraying region including supply openings arranged over a ceiling area thereof for delivering a ventilating gas in downward laminar flows;

a portal framework disposed in the spraying region and including a pair of vertical frames disposed on both sides of a conveying track of articles under a spraying treatment, and a cross frame extending between the vertical frames over and across the article conveying track;

spray guns attached to the cross frame for spraying paint downwardly whereby the cross frame and the spray guns are the only portions of said apparatus positioned over the spraying area to interfere with the laminar flow of the ventilating gas; and a spray gun moving mechanism mounted on the portal framework for reciprocating the spray guns longitudinally of the cross frame, wherein the spray gun moving mechanism includes a cross frame drive mechanism entirely located in the vertical frames and mounted in at least one of the vertical frames, with the cross frame drive mechanism operable to longitudinally reciprocate the cross frame relative to the vertical frames, and with the cross frame formed narrow in width so as to maintain the laminar flow condition of the ventilating gas downwardly of the frame.

2. An automatic painting apparatus as claimed in claim 1 wherein the cross frame drive mechanism includes a motor, a crank mechanism operatively connected to the motor, oscillatable arms operatively connected to the crank mechanism through a link mechanism to be oscillatable back and forth on a vertical axis, a vertical guide rod connected to free ends of the oscillatable arms, a transmission arm in vertically movable engagement with the guide rod, and a vertically movable cross frame support arm operatively connected to the oscillatable arms through the guide rod and the transmission arm to be oscillatable back and forth on a vertical axis.

3. An automatic painting apparatus as claimed in claim 2 wherein the link mechanism interlocking the crank mechanism and the oscillatable arms includes a piece attached to one of the oscillatable arms to act as a pivotal connecting member connected to a crank arm of the crank mechanism, the piece being positionally adjustable longitudinally of the oscillatable arm by turning a screw shaft, and a screw shaft turning motor provided for the oscillatable arm and operatively connected to the screw shaft to act as oscillating stroke adjusting means.

4. An automatic painting apparatus comprising:

a spraying region including supplying openings arranged over a ceiling area thereof for delivering a ventilating gas in downward laminar flows, a portal framework disposed in the spraying region and including a pair of vertical frames disposed on both sides of a conveying track of articles under a spraying treatment, and a cross frame extending between the vertical frames over and across the article conveying track, spray guns attached to the cross frames for spraying paint downwardly, and a spray gun moving mechanism mounted on the portal framework for reciprocating the spray guns longitudinally of the cross frame, wherein the spray gun moving mechanism connects the cross frame to the vertical frames to be displaceable longitudinally of the cross frame, and includes a cross frame drive mechanism mounted in at least one of the vertical frames for reciprocating the cross frame longitudinally thereof, said cross frame drive mechanism including a motor, a crank mechanism operatively connected to the motor, oscillatable arms operatively connected to the crank mechanism through a link mechanism to be oscillatable back and forth on a vertical axis, a vertical guide rod connected to free ends of the oscillatable arms, a transmission arm in vertically movable engagement with the guide rod, and a vertically movable cross frame support arm operatively connected to the oscillatable arms through the guide rod and the transmission arm to be oscillatable back and forth on a vertical axis, said link mechanism interlocking the crank mechanism and the oscillatable arms including a piece attached to one of the oscillatable arms to act as a pivotal connecting member connected to a crank arm of the crank mechanism, the piece being positionally adjustable longitudinally of the oscillatable arm by turning a screw shaft, and a screw shaft turning motor provided for the oscillatable arm and operatively connected to the screw shaft to act as oscillating stroke adjusting means.

* * * * *